United States Patent [19]

Yoshikawa et al.

[11] Patent Number: 4,572,573

[45] Date of Patent: Feb. 25, 1986

[54] DENTAL CHAIR OPERATING APPARATUS

[75] Inventors: Noriyuki Yoshikawa, Ueno; Kunio Fujiyama, Osaka, both of Japan

[73] Assignee: Takara Company, Somerset, N.J.

[21] Appl. No.: 425,302

[22] Filed: Sep. 28, 1982

[30] Foreign Application Priority Data

Oct. 22, 1981 [JP] Japan ..... 56-61151

[51] Int. Cl.[4] ..... A47C 1/035

[52] U.S. Cl. ..... 297/75; 297/83; 297/91; 297/330; 297/340

[58] Field of Search ..... 297/71, 75, 83, 84, 297/90, 91, 312, 330, 340, 355

[56] References Cited

U.S. PATENT DOCUMENTS

| | | | |
|---|---|---|---|
| 910,357 | 1/1909 | Case | 297/358 |
| 2,714,922 | 8/1955 | McKibban et al. | 297/330 X |
| 3,330,595 | 7/1967 | Svärd | 297/71 |
| 3,338,632 | 8/1967 | Kleinsorge | 297/330 |
| 3,414,324 | 12/1968 | Taylor et al. | 297/90 |
| 3,792,905 | 2/1974 | Johnson | 297/330 |

*Primary Examiner*—William E. Lyddane
*Assistant Examiner*—Peter R. Brown

[57] ABSTRACT

A dental chair operating apparatus developed in relation to the underseat and the backrest. The uses for the present chair and integral underseat and backrest configuration include human dental, medical, beauty parlor, and barber shop treatment facilities and installations. The present chair, e.g. a dental chair, is one with a hip section of the underseat baseboard on top of a vertical motion apparatus on top of a base plate; a movable circular arc board with backrest baseboard tilts by an oil-pressured cylinder. The present chair configuration is basically automatic, however it may also be manually manipulated.

4 Claims, 3 Drawing Figures

DENTAL CHAIR OPERATING APPARATUS

BACKGROUND OF THE INVENTION

1. Field of the Invention

An adjustable chair for human dental or medical treatment, beauty parlors, barber shops, or the like.

2. Description of the Prior Art

As is generally known, almost all of dental treatments today are with the patient being treated in lying position. That means that the lying position is easier for treatment than is sitting up position, and is also comfortable for the patient as well; yet, a complete satisfaction was still unobtainable with the conventional chair.

As has been known, the underseat of a dental chair in the past was constructed in a single configuration, in which from the hip section to the leg section of the structure was altogether in one. The part where the legs were to be placed was tilted somewhat, for example downwards. And in addition, although connected to the base plate, this underseat was set up to be capable of making vertical motion. As for the underseat itself, it was not operative. However, in such conventional methods of underseat fabrication, when the upper half of the patient's body was in contact with the backrest in straight or near straight position, there was no problem; but when the backrest was tilted, the lower half of the patient's body, from the area of the knee joint to the hip section, was tilted in one plane. Therefore, when the patient was undergoing a longer period of treatment, 10–20 minutes for example, under the condition especially when the backrest was tilted to a greater degree, for example 60°–90°, there was pain accompanying the patient, particularly in his abdominal muscles.

The prior art includes motor-driven configurations for adjusting the components of a dentist's chair relative to one another. Typical of the prior art is U.S. Pat. No. 3,027,194 which discloses a headrest with a curved shank that has several dimples formed therein. The dimples cooperate with spring-loaded balls to define the locked position for the headrest relative to a vehicle seat. U.S. Pat. No. 3,542,428 discloses an adjustable headrest which has a curved linear member that enables the same to be adjusted relative to the back of an automotive seat. Other prior art of interest includes U.S. Pat. Nos. 694,683; 910,357; 2,481,133; 2,987,116; 3,578,379; and 3,836,197.

SUMMARY OF THE INVENTION

1. Purposes of the Invention

It is an object of the present invention to provide an improved medical (or dental) treatment chair.

Another object is to provide an improved chair for human dental or medical treatment and having an improved adjustable operating apparatus.

A further object is to provide a headrest for a medical or dental treatment chair capable of facilitating the treatment in various ways for doctors and nurses of the physician side, and for the patient, by setting up the angle of elevation of the underseat baseboard and backrest baseboard to a desired degree.

Another object of this invention is in providing an operating apparatus for a medical or dental treatment chair which is capable of facilitating the operation and also stopping firmly at desired position, for having made the aforementioned underseat and backrest baseboards and supporting base plate capable of operating by an oil pressure cylinder, i.e. a hydraulic mechanism.

Another object of this invention is in providing an operating apparatus for a medical or dental treatment chair, or a chair for beauty parlors, barber shops, or the like, which is capable of adjusting to the height or size of the patient.

An object is to provide such a chair, and a chair operating apparatus, which is developed in relation to the underseat and the backrest.

Another objective is to provide a dental chair operating apparatus capable of freeing the patient from being in an unnatural position not only when the backrest is tilted to 30°, but also when it is tilted to greater degree, for example 60°–90°, and thereby eliminating the discomfort of the patient when he is undergoing a longer period of treatment.

Another objective is to provide a dental chair operating apparatus capable of tilting the backrest to various levels and also maintaining it at the tilted position as well.

These and other objects and advantages of the present invention will become evident from the description which follows.

2. Brief Description of the Invention

This invention was developed especially for the purpose of dental treatment; however, it also is applicable to other diverse fields of medical treatment such as otorhinolaryngology and opthalmology as well, and relates to an operating apparatus for a medical treatment chair, or for a chair amenable to usage in a barber shop, beauty parlor, or the like, or any suitable treatment facility or installation where a human patient or other person is to be treated or provided with any human bodily service or treatment. Therefore, it will be understood that within the context of the present invention, the present chair device is applicable to both dental and medical treatments per se, and it will be understood that the invention encompasses and includes all these various methods of treatment known to the various medical arts, including dentistry, which are practiced in a chair or in which the human patient is treated in a chair.

In general, the present chair operating apparatus was developed in relation to the underseat and the backrest. The uses for the present chair and integral underseat and backrest configuration include human dental, medical, beauty parlor, and barber shop treatment facilities and installations. The present chair, e.g. a dental chair, is one with a hip section of the underseat baseboard on top of a vertical motion apparatus on top of a base plate; a movable circular arc board with backrest baseboard tilts by an oil-pressured cylinder. The present chair configuration is basically automatic, however it may also be manually manipulated. More specifically, the present invention entails a chair operating apparatus characterized by having set up a hip section of underseat baseboard, on top of the universally-known vertical motion apparatus, and being set up on top of a base plate. While in addition a movable circular arc board is set up with a backrest baseboard which tilts by an oil-pressured cylinder which is set up on an upper thigh underseat baseboard, with a lower leg underseat baseboard in alignment with the working of the movable circular arc board, to the hip section of underseat baseboard mentioned earlier, enabling it to turn. Since this invention is made as mentioned above, it is capable of freeing the patient from being in an unnatural position, not only when the backrest is tilted to 30°, but also when it is tilted to greater degree, 60°–90° for example. Therefore, it is capable of eliminating the discomfort of the patients when they undergo a longer period of treatment. It is also capable of tilting the backrest to various levels and maintaining it firmly at the tilted position as well. Thus, the present invention entails a chair for dental or medical treatment or the like having an improved operating apparatus.

The present chair and integral operating apparatus configuration stresses the importance of the natural movement of the doctor, dentist, beauty parlor operator (such as a hairdresser), or barber, and that of the patient or person undergoing the treatment, whatever it may be. It was determined that the pivot of rotation, e.g. axis, is being disposed in the body of the patient or person. Consequently, the natural movement of the doctor, dentist, etc., has become as natural as this pivot of rotation or axis of the patient or person being treated.

Axis 2 is the supporting point of rotation of the backrest, resembling the patient's hip movement, when being raised or laid down. Any position the doctor or dentist desires can be obtained by just one switch. No eye and hand movement of the doctor or dentist or the like is wasted, no mouth or other bodily movement of the patient is wasted, and yet the position is not unnatural. As an objective, it was endeavored to achieve and pursue a configuration aimed at the doctor's and patient's natural positions, and consequently the present chair and integral apparatus configuration was developed and brought to completion. The doctor (or dentist) can now obtain any position necessary for performing the treatment by one switch. Thus, the present chair and integral apparatus configuration, as contemplated and described, and as claimed infra, represents an advance in the art of dental chairs, and is designed so as to accommodate and adapt to the doctor or dentist by uniting the patient and the Axis as one. The present configuration anticipates future developments, and represents a conclusion form as to such chairs with integral apparatus. The present chair in practice is bolstered and made most operable and efficient by electric-powered oil pressure and electronic technologies.

To review the advantages of the present chair and integral apparatus configuration, at the onset, the axis-power apparatus can obtain a wider view of the inside of the mouth. In addition, the doctor can now perform the treatment in a comfortable position, while looking in directly. Other advantages include that for the first time, the apparatus is electric-powered. Now that the patient can open his mouth wide with ease, the doctor's assuming of an unnatural position and unconscious shifting of the body become much less while he (the doctor) is looking in directly.

Another advantage is that the up and down adjustment of the apparatus is also done by switch. The electric-powered oil pressure system enables the up and down adjustment of the apparatus to various levels by one switch.

The movement of the axis backrest also causes hardly any back slippage. The supporting point of the rotation of the axis backrest, being set in the patient's hip, is the Axis 2. The movement of the backrest in the present Axis design is made by the guide of a circular arc at the lower end of the backrest, rotating with the Axis 2 as its center. The back slippage, and the slippage between the headrest and the head due to raising and lowering of the backrest, occur much less frequently. The design of the seat also strives for fitting of the patient's hip.

Other considerations include the fact that according to the frequency of usage and the hand movement of the doctor, the present Axis control zones are arranged functionally. Thus, a #1-Control Switch (Top Mount Section), which is a control switch that is high in frequency of usage for top mount which the doctor can operate with facility, is installed. It is easily recognizable, and therefore it prevents operational error. Also, the present development features a #2-Control Switch (Elbowrest Section); the angle of the backrest and the up and down of the base can be operated either from the doctor's or the assistant's side. The following switches are typically provided:

1. auto-return switch
2. and 3. position pre-set switch
4. backrest reclining switch
5. base up and down switch.

A further advantage is that in the present chair and integral headrest configuration, correct operation by one switch is accomplished in the present axis treatment approach as follows:

By one up and down switch, the sitting height of the patient can be adjusted.

By one pre-set switch, the 2 memories of treatment position can be obtained.

With regard to the 2-position Electron Memory System, for the pre-set, the 1C Window Comparator system, capable of obtaining correct memory, is employed. A Foot Switch (option) allows the up and down of the base and the angle of the backrest to be operated by foot. With regard to the backrest, the reverse side of the backrest is designed slimly, slanting the sides. It is designed so that approaching the patient can be made with ease. As for the armrest, since the right side of the armrest opens at its side, in and out entry or egress of the patient can be made with ease. There is also an "Almighty Cancelling System." While the chair is in automatic operation, the emergency stop can be made instantly by pushing any of the switches.

The specifications of the present axis-type chair and integral apparatus may be summarized as follows:

Base Up and Down System: Electric-powered Oil Pressure Canti-Lever System

Base Stroke: 380 mm (the lowest height 420 mm, the maximum height 800 mm)

Angle of Backrest: 70° at standing, 0° at the maximum declivity

Tilt System: Reclining Linkage Tilt (Legrest Linkage)

Angle of Tilt: 13° at standing, 25° at maximum declivity

Armrest: Rotating System with Opening on the Side

Chair Control: Low Voltage (DC 12 V) Electronic Control Circuit

Pre-set System: Cancelling Can Be Done by All Switches

Material of Seat, Backrest, and Arm Covers: Vinyl Leather

Base Material: Cast Iron

Gross Weight: 136 kg

—Option—Foot Switch: Switch for Up and Down of Seat and for Raising and Lowering of the Backrest In one embodiment of the invention, the present chair for human dental or medical treatment and having an improved adjustable operating apparatus support, includes a chair per se, the chair having a frame; a seat for receiving and supporting the body of a human patient, the seat being mounted and supported on the frame; and operating apparatus wherein the chair and appurtenances thereto are enabled to turn. The chair basically includes a chair per se, the chair having a frame; a seat for receiving and supporting the body of a human, the seat being mounted and supported on the frame; The frame of the chair is characterized by the provision of a set up hip section of an underseat baseboard, the set up hip section being disposed on top of a vertical motion apparatus and being set up on top of a base plate; a moveable circular arc board, the arc board having a backrest baseboard; so that while the hip section of the underseat baseboard is set up, the arc board tilts by action of an oil pressure cylinder, to produce a concomitant setting up of an upper thigh underseat baseboard with a lower thigh underseat baseboard, the baseboards being in alignment with the working of the movable circular arc board and the hip section of said underseat baseboard, so that the baseboards are enabled to turn. Typically, the backrest may be tilted not only to 30° but also to a greater degree in the range of about 60° to 90°, and the backrest is capable of being tilted to various levels and maintained firmly at the tilted position.

The invention accordingly consists in the features of construction, combination of elements, and arrangement of parts, which will be exemplified in the device and article of manufacture hereinafter described, and of which the scope of application is as elucidated supra and as will be indicated in the appended claims.

BRIEF DESCRIPTION OF THE DRAWINGS

Next, attaining of above mentioned objectives will be explained in detail with an example of this invention with figures.

Simple Explanation of the Figures

The figure are one example of the dental chair operating apparatus of this invention.

Figure 1:
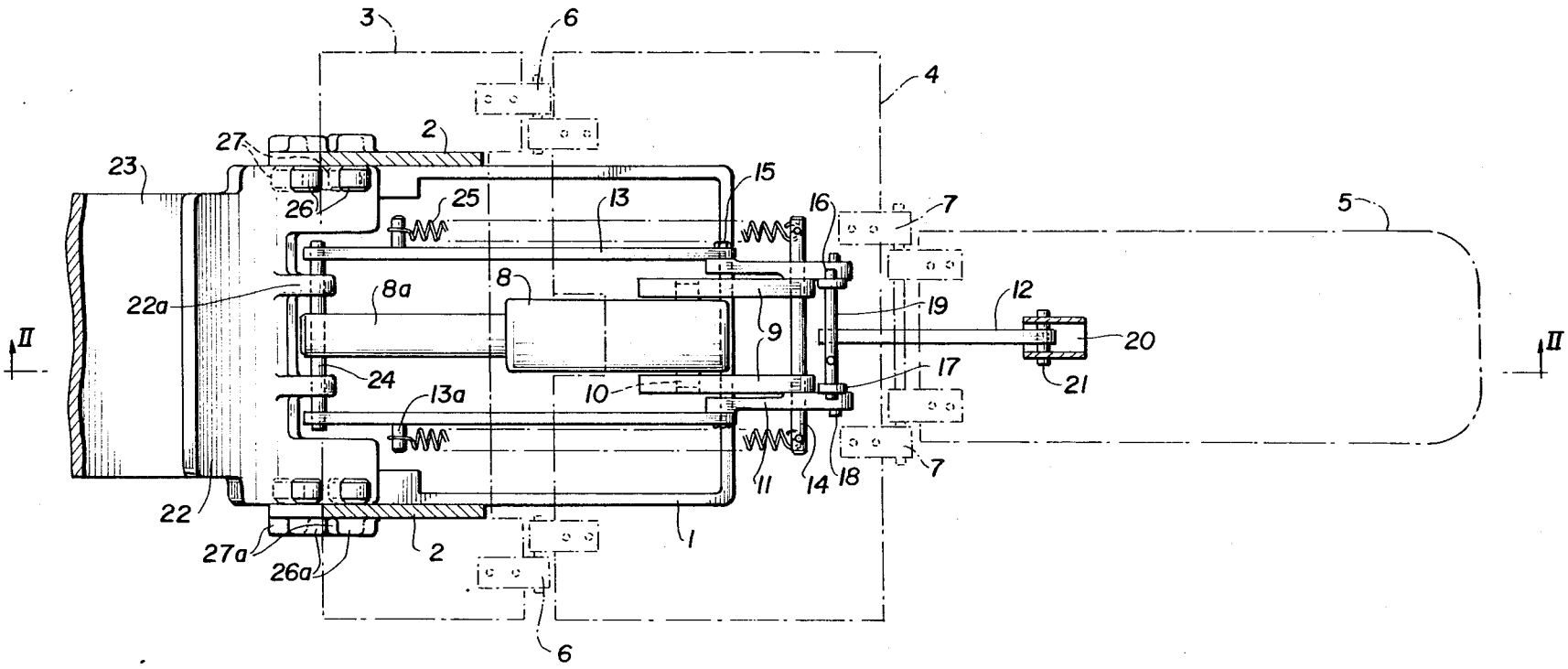
Figure 2:
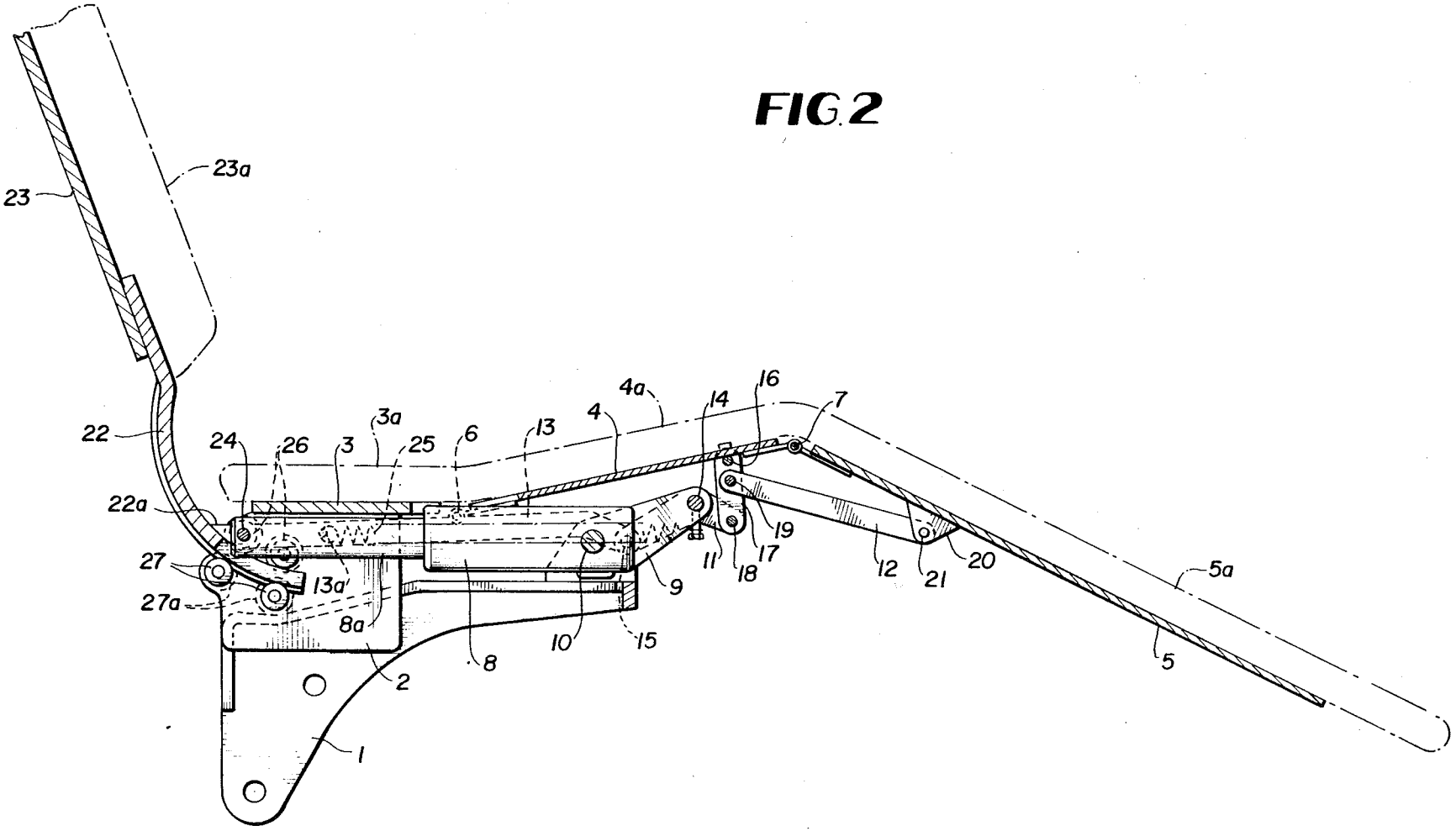
Figure 3:
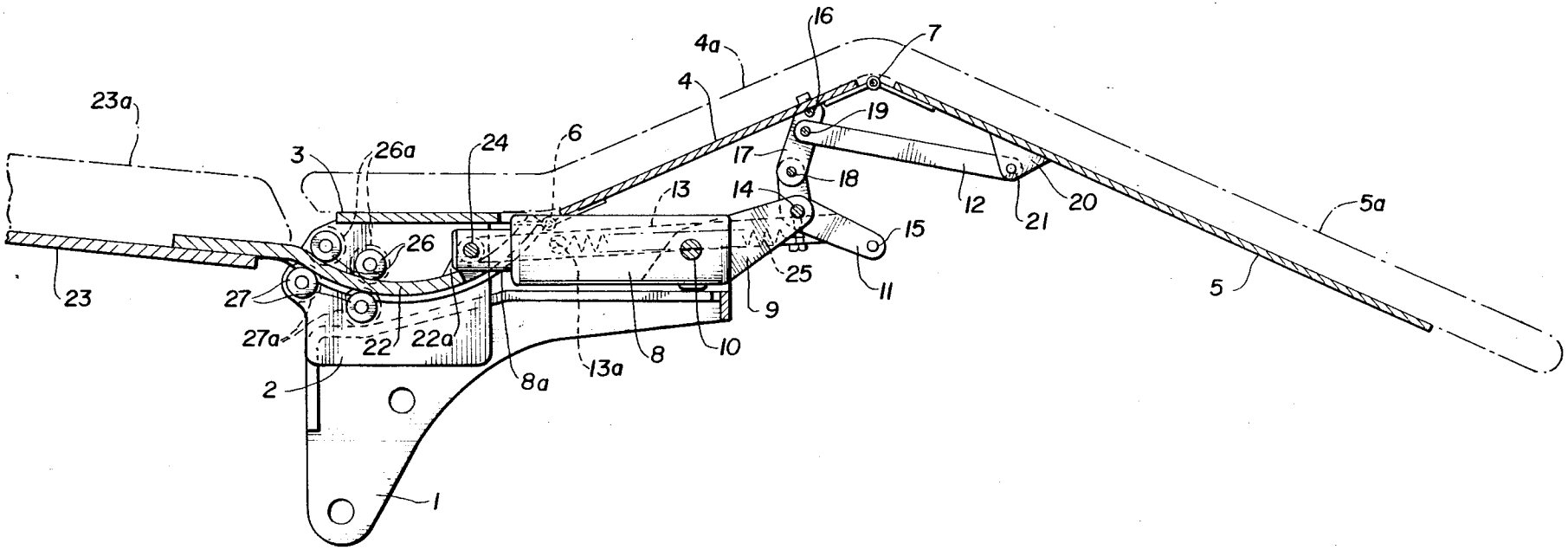

The FIG. 1 is the horizontal plane;

the FIG. 2 is the cross-sectional view of the II—II line of the same; and the FIG. 3 is the cross-sectional view of operating condition of the same.

3. Hip section of underseat baseboard.
4. Upper thigh underseat baseboard.
5. Lower leg underseat baseboard.
8. Oil pressured cylinder.
22. Movable circular arc board.
23. Backrest baseboard.

The 1 is base-frame which will be fixed to vertical motion apparatus known to all set up on top of base plate; the 2 is right and left side of board fixed at the rear of right and left of the base-frame 1; the 3 is hip section of underseat baseboard with hip section of underseat section 3*a* fixed at the top of the right and left board 2; the 4 is upper thigh underseat baseboard with upper thigh underseat section 4*a*; and the 5 indicates lower leg underseat baseboard with lower leg underseat section 5*a*. The upper thigh underseat baseboard 4 is being set up to the hip section of underseat baseboard 3, enabling it to make the vertical motion via hinge 6, and the lower leg underseat baseboard 5 is being set up to the upper thigh underseat baseboard 4, enabling it to make the vertical motion via hinge 7.

The 8 indicates oil pressured cylinder with plunger 8*a*, and the base part of the said oil pressured cylinder 8 is being set up to the right and left of supporting board 9 set up at the front part of the base-frame 1, enabling it to make turn via shaft 10. The 11 is the 1st linkage board; the 12 is the 2nd linkage board; and the 13 indicates longitudinal motion board. And the midway of the 1st linkage board 11 is being inlaid into the front part of long shaft 14 set up at the side of the front part of the right and left supporting board 9, enabling it to make turn with one edge attaching to one edgepart of longitudinal motion board 13, enabling it to turn via shaft 15. Also, the other edge of the 1st linkage board 11 is being attached to operating board 17, enabling it to turn via shaft 18, that is being set up to the back of the upper thigh underseat baseboard 4, enabling it to turn via shaft 16. Furthermore, the midway of the operating board 17 is being attached to the rear edge of the 2nd linkage board 12, enabling it to turn via shaft 19, and the front edge is being attached to projecting piece 20 set up to the back of lower leg underseat baseboard 5, enabling it to turn via shaft 21.

The 22 indicates movable circular arc 23 with backrest 23*a* fixed to the front edge part, and at the base edge part of the said movable circular arc board 22, 2 pieces of bearing board 22*a* are being fixed. The rear part of long shaft 24 is being inserted at the other edge part of this bearing board 22*a* and aforementioned longitudinal motion board 13 and the front edge part of plunger 8*a*. In other words, to the rear part of long shaft 24, the bearing board 22*a*, the longitudinal motion board 13, and the plunger 8*a* are being set up, enabling it to turn. And between the projecting strut 13*a* being set up on the longitudinal motion board 13 and the front part of the long shaft 14 mentioned earlier, a coil spring 25 is being stretched.

The 26 and 27 indicate the upper and lower parts of roller groups being set up to the right and left side of board 2 at a fixed intervals via bearing 26*a* and 27*a* respectively. (Note; In the diagram, they are made with 2 rollers each). And between the said upper roller group 26 and lower roller group 27, a movable circular arc board 22 is being inserted. Not illustrated, however, at the very top of the backrest baseboard 23, the headrest, known to all, is being set up.

Next, to explain its function would be that: At the FIG. 2 condition, the patient will place his upper thigh part to upper thigh backseat part 4*a* and the lower leg to lower leg underseat part 5*a* as sitting on the underseat 3*a*, and place his back part to backrest 23*a*, pushing back the plunger 8*a* of the oil pressured cylinder 8 suitably as required. At this time, with the advancement of the plunger 8*a*, via rear part of long shaft 24 and bearing board 22*a*, and in addition, opposing to the spring action of the coil spring 25—that is, as compressing the coil spring 25 via upper part of roller group 26 and lower part of roller 27—the movable circular arc board 22 makes the forward movement. Therefore, the backrest baseboard 23 with backrest 23*a* tilts backward, corresponding to the degree of backward movement of the plunger 8*a*. (For example: it tilts as in the FIG. 3). And with the operation mentioned, the longitudinal motion board 13 makes forward movement via rear part of long shaft 24, that is, as in the FIGS. 1 and 2, it moves toward right; and complying to this move, the 1st linkage board turns counterclockwise, the front part of long shaft 14 as its fulcrum. Complying to the movement mentioned of the 1st linkage board 11, the upper thigh underseat baseboard 4 tilts upward via operation board 17 and the hinge 6 as its fulcrum. The lower leg underseat baseboard 5 also tilts upward via the 2nd linkage board 12 and the hinge 7 as its fulcrum. And by advance forward the plunger 8*a* of the oil pressured cylinder 8 from this condition, the various mechanism, operating in opposition to the aforementioned return to the original position as in FIG. 2.

However, this invention is not limited only to this one example; it can also be designed as below:

(I) In place of the upper roller group 26 and the lower group 27, a guide-frame shaping a circular arc can be set up.

(II) The backrest baseboard 23 can be built together with the movable circular arc board 22 in one. In other words, extend the upper part of the movable circular arc board and use it as the backrest baseboard.

(III) Since the coil spring 25 is a mere supplemental, it can be omitted.

(IV) The lower leg underseat baseboard 5 can be built together with the upper thigh underseat baseboard 4 in one; that is, without employing the hinge 7, it can be made as not operative.

It thus will be seen that there is provided a chair operating apparatus, e.g. a dental chair, which achieves the various objects of the invention, and which is well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby, since the embodiments of the invention particularly disclosed and described herein above are presented merely as an example of the invention. Other embodiments, forms, and modifications of the invention, coming within the proper scope and spirit of the appended claims, will of course readily suggest themselves to those skilled in the art. Thus, while there has been described what is at present considered to be the preferred embodiments of the invention, it will be obvious to those skilled in the art that various changes and modifications may be made therein, without departing from the invention, and it is, therefore, aimed in the appended claims to cover all such changes and modifications as fall within the true spirit and scope of the invention.

What is claimed is:

1. A chair comprising:

(a) a frame (b) a seat for receiving and supporting the body of a human, said seat being mounted and supported on said frame and comprising a hip underseat baseboard, upper thigh underseat baseboard and lower leg underseat baseboard (c) a backrest means comprising a backrest baseboard attached to a flat curved strip member, means mounted between said frame and said strip member for guiding movement of said strip member in an arcuate path so that the movement of said backrest baseboard corresponds to movements of the human body and wherein said strip member is also attached to means for moving said strip member in the arcuate path, movement of said strip member positioning said backrest in various positions, from vertical to horizontal (d) said upper thigh underseat baseboard movably mounted along one edge thereof to said hip underseat baseboard and movably mounted along an edge opposite said one edge to said lower leg underseat baseboard, and means for moving said upper thigh underseat baseboard in a substantially angular direction in a way corresponding to the natural movement of human thigh, while said backrest moves in a way corresponding to the movement of the hip, said movement of said upper thigh underseat concommitant with the movement of said, backrest by means connecting said backrest and underthigh underseat baseboard and;

(e) said lower leg underseat baseboard having means interconnected to said upper thigh underseat baseboard for moving said lower leg underseat baseboard concommitant with the movement of said backrest and upper thigh underseat baseboard in a manner corresponding to the natural movements of human lower leg, (f) said means for guiding said strip member in an arcuate path including at least one pair of opposed cylindrical guide rollers, said rollers straddling said strip member and extending contiguously across the surface of said strip member substantially transverse to the linear longitudinal axis of said strip member along said longitudinal axis, so as to guide the motion of said strip member along said longitudinal axis.

2. The chair of claim 1 in which the backrest is capable of being tilted to desired levels and maintained firmly at the tilted position.

3. The chair of claim 1, wherein said means for moving said strip member in an arcuate path consists of a principal hydraulic mechanism, said principal hydraulic mechanism comprising a principal fluid pressure cylinder linked at one end to said frame, said cylinder containing a piston plunger having a piston head; the outer end of said piston plunger being pivotally attached to the other end of said strip member by a transverse supporting shaft and bearing board, wherein said piston plunger moves in a horizontal path causing said curved strip member to move in a radial path, and where said hydraulic mechanism further includes means to pass a hydraulic fluid into said cylinder to displace said piston head and piston plunger in said cylinder.

4. The chair of claim 1, where said backrest is positioned at an angle greater than 30° in relation to underseat baseboard.

* * * * *